United States Patent [19]

Lohausen

[11] Patent Number: 4,566,516

[45] Date of Patent: Jan. 28, 1986

[54] JOINTED ARM MECHANISM FOR AN AWNING

[76] Inventor: Viktor Lohausen, Goldmühlestrasse 99/2,, D-7032 Sindelfingen, Fed. Rep. of Germany

[21] Appl. No.: 673,913

[22] Filed: Nov. 21, 1984

Related U.S. Application Data

[63] Continuation-in-part of Ser. No. 469,728, Feb. 25, 1983, abandoned.

[30] Foreign Application Priority Data

Feb. 27, 1982 [DE] Fed. Rep. of Germany ..... 3206963

[51] Int. Cl.[4] ..... E04F 10/06

[52] U.S. Cl. ..... 160/22

[58] Field of Search ..... 160/22, 67, 68, 70, 160/78

[56] References Cited

U.S. PATENT DOCUMENTS

| | | | |
|---|---|---|---|
| 1,833,688 | 11/1931 | Nelson et al. | 160/22 |
| 2,740,470 | 3/1956 | D'Azzo | 160/22 |
| 3,782,443 | 1/1974 | Clauss et al. | 160/22 |

FOREIGN PATENT DOCUMENTS

| | | | |
|---|---|---|---|
| 1683027 | 8/1978 | Fed. Rep. of Germany | 160/70 |
| 2752807 | 5/1979 | Fed. Rep. of Germany | 160/22 |

*Primary Examiner*—Ramon S. Britts
*Assistant Examiner*—Cherney S. Lieberman

[57] ABSTRACT

This invention relates to a jointed arm mechanism for an awning, the angle of inclination of which is adjustable. Preferably, there are tilt-up check means to prevent an unintentional tilt-up movement of the awning. The mechanism has support providing a horizontal tilting axis for a bearing block assembly. This assembly comprises a first jointed arm section pivoted on a joint of the bearing block and connected to a second jointed arm section through an intermediate joint. A tilting limiter for the tilting movement of the bearing block assembly about the tilting axis comprises a screw bolt which is pivotable about a horizontal swivel axis and has a counter-abutment means thereon cooperating with an abutment surface of the bearing block. This counter-abutment means comprise a body of rotation and is disengaged form the abutment surface when the awning is fully coiled on a shaft and the bearing block takes an initial position.

14 Claims, 21 Drawing Figures

94
92
89
88
69
46
93
96
48
29
58
54
59
68
67
57
99
86
31
97
74
52
76
62
53
49
79
88
71
102
82
84
61
77
78
81
98

FIG. 5
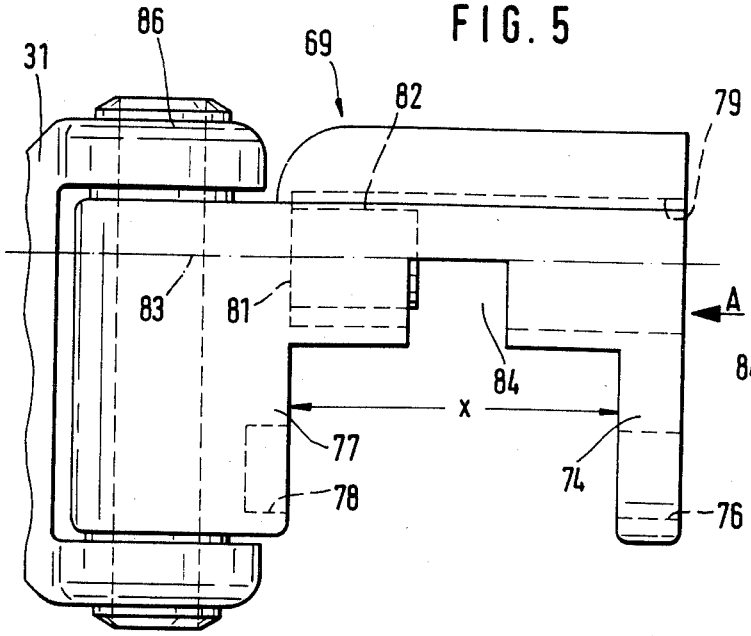
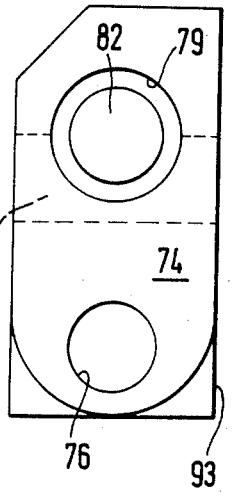
FIG. 6
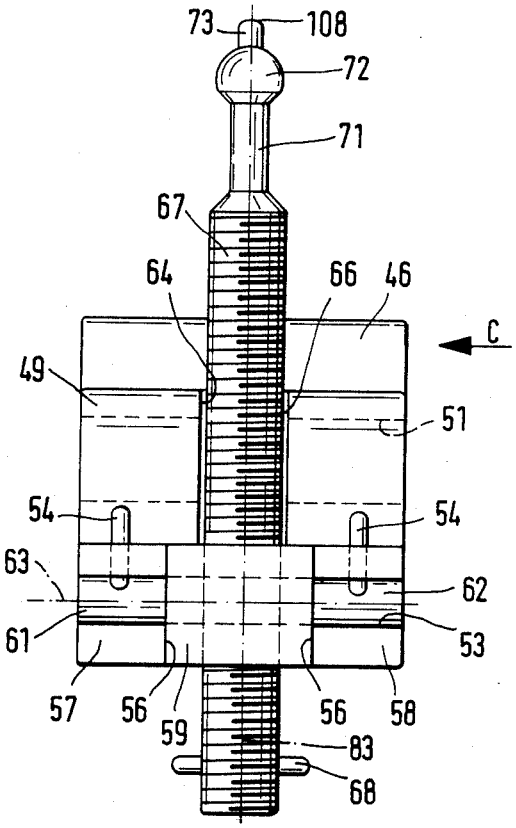
FIG. 9

FIG. 7
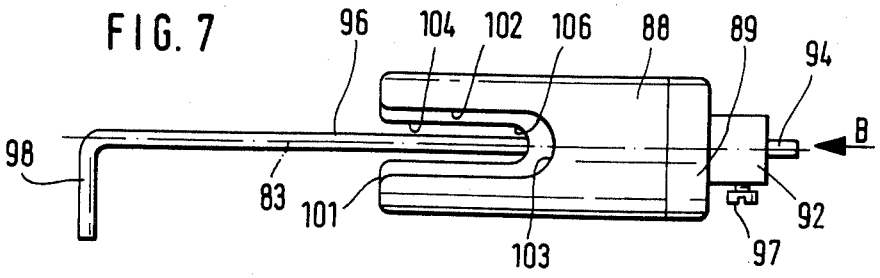
FIG. 8
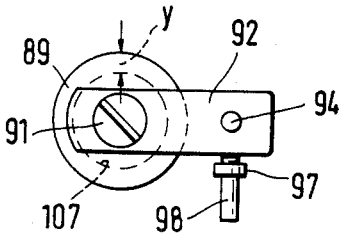
FIG. 10
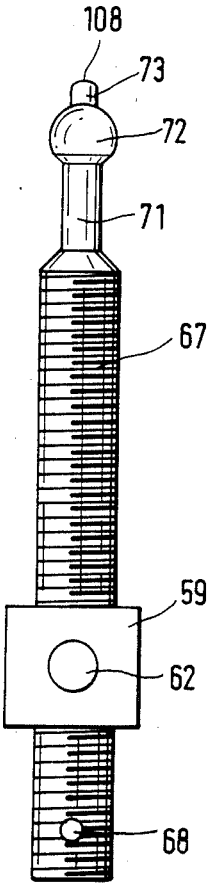
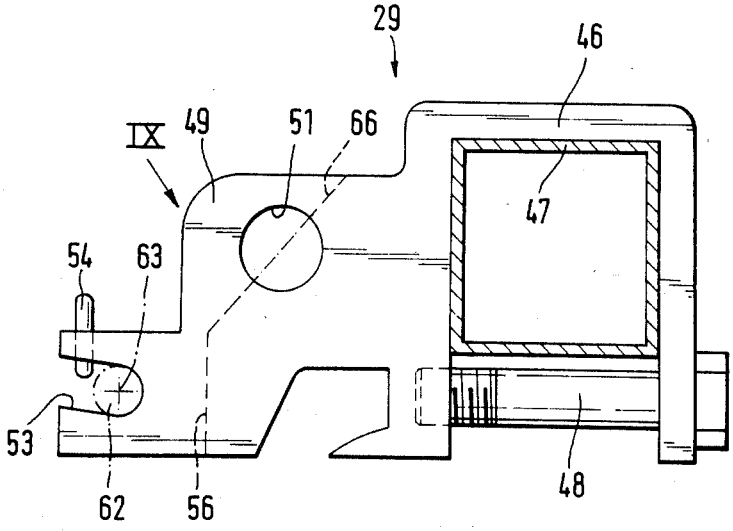
FIG. 11

JOINTED ARM MECHANISM FOR AN AWNING

This application is a continuation-in-part of application Ser. No. 469,728 filed Feb. 25, 1983, now abandoned.

FIELD OF THE INVENTION

The invention relates to a joint according to the following description: the joint is part of a jointed arm mechanism for an awning rolled upon a horizontal shaft, said mechansim comprising jointed arms pivoted on a fixed horizontal support frame, by means of a bearing block body tiltable about an axis parallel to the axis of the shaft. The tilting angle of this bearing block body during its tilting movement, that is automatically effected at the beginning of the extension of the awning, is limited by a tilting limiter having a screw bolt which is mounted on the support frame to be rotated about its axis but is fixed in axial direction. One end of the screw bolt is provided with a turning actuator device. The screw bolt has a stop gauge cooperating with a counterstop on the bearing block body.

BACKGROUND OF THE INVENTION

Jointed arm mechanisms for awnings are required to be of optimally flat construction, so that they are not esthetically disturbing in the retracted state. Such mechanisms may either be mounted totally unmasked, or may be inserted into a masking box in which the awning together with its mechanism disappears totally in the retracted position.

Awnings having a jointed arm mechanism are very rarely positioned to include in their extended position an angle of 0° to a horizontal plane. They generally take an angle of around 10°. The maximum downward inclination is generally about 45°. It is difficult for a designer to produce mechanisms for awnings of flat construction and at the same time to make it possible for them to have a great inclination angle when they are extended. Frequently the terminal bar or sally tube provided at the free end of the joint arms closes, either itself or conjointly with a screen, the masking box which also may merely be in the form of a rain protection roof. If the inclination of the awning were selected somewhere between 45° and 0° according to clients' wishes, then obviously the screen and the terminal bar would also have this inclination, and consequently assume a different position to the rain protection roof or masking box.

Now, in order to permit a reasonably flat construction, but nevertheless always to have the same geometrical conditions in the region of the sally tube when the awning is fully retracted irrespective of the previous angle of inclination, the so-called tilting joint mechanisms have been developed. Irrespective of the desired angle of inclination, in this construction it is always guaranteed that the sally tube has the same position in the retracted state of the awning. Such mechanisms have an additional joint with the horizontal axis for each joint arm at its inner end region. When the awning shaft is rotated to extend the awning, the previously folded joint arms open in a substantially horizontal plane up to approximately 10°. Only after this, the extensible part of the mechanism is overbalanced, mainly due to the weight of the terminal bar or sally tube, and the mechanism tilts downwards about the tilting joint by an angle corresponding to the adjusted value, for example somewhere between 10° to 45°. Devices of this type are disclosed in principle in U.S. Pat. Nos. 2,740,470 and 3,782,443.

Since such an awning can tilt downwards, it can also tilt upwards, particularly in the fully extended position. This may occur in the presence of gusts of wind. The forces which then act make the mechanism at least a case for repairs.

For this reason a device used in West Germany has become known, which prevents such cases by a tilt-up check device. In this case a short rod which extends in the bearing block body behind the inner joint of the inner joint arm, reciprocates in a brass slide which is guided in the body. The ratio of travel distances between the angular movement of the inner joint arm and the brass slide piece is such that immediately after the awning tilts, the inner edge of the slide piece slides over the external end face of a nut and then clamps this nut between itself and the rear wall of the body. The nut is screwed onto a screw bolt within the recess of the body. The farther the nut is unscrewed, the greater will be the inclination of the awning.

The screw bolt penetrates the rear wall of the recess in the body. It is a disadvantage of this known mechanism that it can be inclined only approximately up to 45°. An inclination up to 90°, that is to say vertically downwards, would be desirable. This would be good for upper storey balconies in tall buildings. There are also commercial areas where it is a building regulation that awnings and blinds may only be released vertically downwards. With the known mechanism for the adjustment of merely 45° a socket wrench is needed. Even with a socket wrench available, any adjustment can only be made in a quite specific intermediate position of the awning, which is difficult to do even for trained fitters.

A ladder is always necessary for such operation with a socket wrench. The screw bolt must be of steel. The body is always aluminum for considerations of weight and cost. The screw thread therefore acts as a saw on the aluminum casting. When the originally circular hole in the rear wall of the recess of the body has been sawn into a slot, the tilt-up check device will no longer operate. Although the purely external appearance of this tilt-up check device simulates a very robust construction, the slide piece bears upon the end face of the nut at only a few points. The slide piece has to be very robust because it has, in the projection of the screw bolt, an open-edged recess which is necessary, if it is desired to set inclinations of for example only 20°. The slide piece is guided floatingly in translation in the body and consequently a strong robust brass block is necessary. The roll of the awning arranged in the rear of the box has to be carried past the body of relative cumbersome construction. This, and also the bulky construction of the tilt-up check device prohibit the design of a masking box lower than 19 cm.

OBJECT AND STATEMENT OF THE INVENTION

It is an object of the invention to improve a jointed arm mechanism of the type described so that inclinations quite substantially beyond 45°, if possible up to 90°, are obtainable and the degree of inclination is conveniently adjustable even by a layman. At the same time the mechanism should be no higher, if possible flatter, in construction. The same applies to the depth.

This object is achieved according to the invention by a screw bolt which is pivotable about a horizontal axis corresponding to the angle of inclination of the jointed arm mechanism and is articulated to a horizontal joint, an internally threaded element forming the stop gauge which is connected to the screw bolt, and a holding element surrounding the internal threaded element to form the counter-stop, wherein the internally threaded element is a thickened part having the configuration of a body of rotation generated about the geometrical longitudinal axis of the screw bolt, the holding element is a tube, the internal cross-section of which is complementary to the contour of the body of rotation and can hold the body of rotation. Preferably, the screw bolt has a length which admits an angle of inclination substantially beyond 45°, up to 90°, and the axis of the screw bolt is situated at that geometrical locus which admits a pivoting from approximately 0° up to the maximum angle of inclination.

The screw bolt is easily rotatably supported on the support frame. If, for example, it is provided with a cross-bore at its accessible end, it may be turned by a customary crank rod.

Advantageously, the invention has the following additional features:

The internal element may be a ball which is provided at an end of the screw bolt through a shank. The screw bolt is rotatable in a nut with an internal screw thread. The nut may be pivotable about the horizontal axis. This axis is then situated in front of and beneath the axis of the first and second jointed arm sections. The tilt-up check device may comprise a cylindrical tube section which is reciprocatingly movable in a similar transverse recess of the bearing block body. The body has a wide aperture extending in the direction towards the axis of the nut and intersecting the transverse recess which permits the entry of the ball, the shank and the adjoining region of the screw bolt. The ball has preferably in its region opposite the shank a coaxial distance pawl in order to be centered relative to the inner faces of the tube section. The tube section has at its inner end face two open-edged incisions which are diametrally opposite and of which the front one is wider than the shank and the rear one may be wider than the distance pawl. The distance pawl and the shank are substanially as long as the thickness of the tube section.

This leads to a construction which can be built extremely close to the support frame and which therefore requires little space in horizontal and vertical directions. Moreover, in this case it is possible in all positions of inclination of the awning to adjust this inclination easily from underneath at the front, because the lower free end of the screw bolt always points in this direction. Lastly, such a device is very low overall.

The shank is approximately $\frac{1}{3}$ to $\frac{1}{2}$ as thick as the screw bolt. The shank is 0.4 to 0.9 mm thick, preferably, 0.7 mm thick.

The resulting consequential measures lead to an embodiment which is stable on the one hand, and which can absorb all forces, and this construction is nevertheless elegant.

The distance pawl is $\frac{1}{3}$ to 1/6 as thick as the screw bolt, and ends in a hemisphere. The distance pawl is 0.3 to 0.6 mm thick, preferably 0.4 mm thick.

The features permit the open-edged indentation belonging to the distance pawl to be kept sufficiently small.

The front open-edged incision may be widened in V-shaped configuration towards the edge, and the rear open-edged indentation widens in V-shaped configuration towards the edge.

These features produce a catch effect, and the tube can be rotated automatically into the correct position with the aid of the oblique incisions.

The tube may be guided transversely to the screw bolt in a cylindrical bore of the bearing block body. Furthermore, a bearing cylinder may be provided in the transverse bore and coaxially thereto at its one end, onto which the tube rides up in its region of the incisions when it is retracted.

These features lead to a construction cheap to produce in spite of high precision of fit. The bearing cylinder with its front face provides an abuttment surface for the ball.

The features permit the axis of the screw bolt to be positioned farther inwards.

The tube may, however, also be rotatable about its geometrical longitudinal axis, but is not slidable thereon. In this case, the first jointed arm section is connected to the tube for transmitting its movement to produce a rotation of the tube, which connection may be effected by a bevel gear on the tube which meshes with a bevel wheel. This bevel wheel is fixed to a shaft which forms the axis of rotation of the first arm section. Preferably, the bevel wheel may be axially slidable on the shaft at least by the height of its teeth. An annular cam may be fixed on the lower side of the bevel wheel which has suitable cam follower means so that both bevel gears are only in engagement during an angle determined by the elevations of the cam. In this way, a complicated reduction gear can be avoided.

These features lead to a construction which avoids also the sliding bar of the first ambodiment, which is, of course, stressed both in traction and in compression during the actuation of the holding element.

The tube has a radial wall recess which is slightly greater than the contour of the ball element. A radial slot extends upwards from this wall recess, which slot is substantially narrower than the contour of the ball element, and wider than the cross-section of the shank.

These features produce a kind of hooking slot which, after the awning is tilted forward, engages behind the ball element after only a slight unwinding of the awning, and then holds it entirely securely to prevent or check a tilt-up of the awning as a result of gusts. Moreover, in the case of a rotating tube section, it is supported by its peripheral surfaces at both ends and is also more stable against any load.

The screw bolt may, however, also be arranged substantially above the bearing block body in accordance with a third embodiment. The rear end of the screw bolt may carry a gear which meshes with a drive gear mounted on an inclination adjusting shaft. The inclination adjusting shaft extends approximately parallel to the bearing block body and its tilting axis, and has at one end a 90° transmission. An operating shaft actuable from below the mechanism may be connected to this inclination adjusting shaft.

This embodiment is suitable for a more expensive construction, in which the entire awning can be adjusted as to inclination at only a single point, namely by the operating shaft.

The internally threaded element is permanently located in a tube which is let into a body. The body exhibits a circumferential slit in each of those regions in which it is penetrated by the screw bolt. Narrow webs remain between the ends of the circumferential slits.

The tube is fitted in a circular cylindrical cavity of the bearing block body. A rotational stop device may be provided which prevents any rotation of the internally threaded element relative to the tube during rotation of the screw bolt.

These features produce stability combined with further adjustability and large support surfaces.

BRIEF DESCRIPTION OF THE DRAWINGS

Preferred exemplary embodiments of the invention will now be described. In the drawing:

FIG. 5 is front view similar to FIG. 2, but showing only the details of the bearing block body with the internal joint of the internal joint arm section;

FIG. 6 is a side-view according to the arrow A in FIG. 5;

FIG. 7 shows the holding element including the sliding bar in detail in a similar view as in FIG. 2;

FIG. 8 is a side-view according to the arrow B in FIG. 7;

FIG. 9 is an oblique view onto the screw bolt including nut and the support block, corresponding substantially to the arrow IX of FIG. 11;

FIG. 10 is a view of the screw bolt and its nut alone from the direction of the arrow C in FIG. 9, but without the support block;

FIG. 11 is the side elevation of the support block of FIG. 9 alone, substantially according to the arrow C, but without the screw bolt;

DETAILED DESCRIPTION OF THE INVENTION

Figure 1:
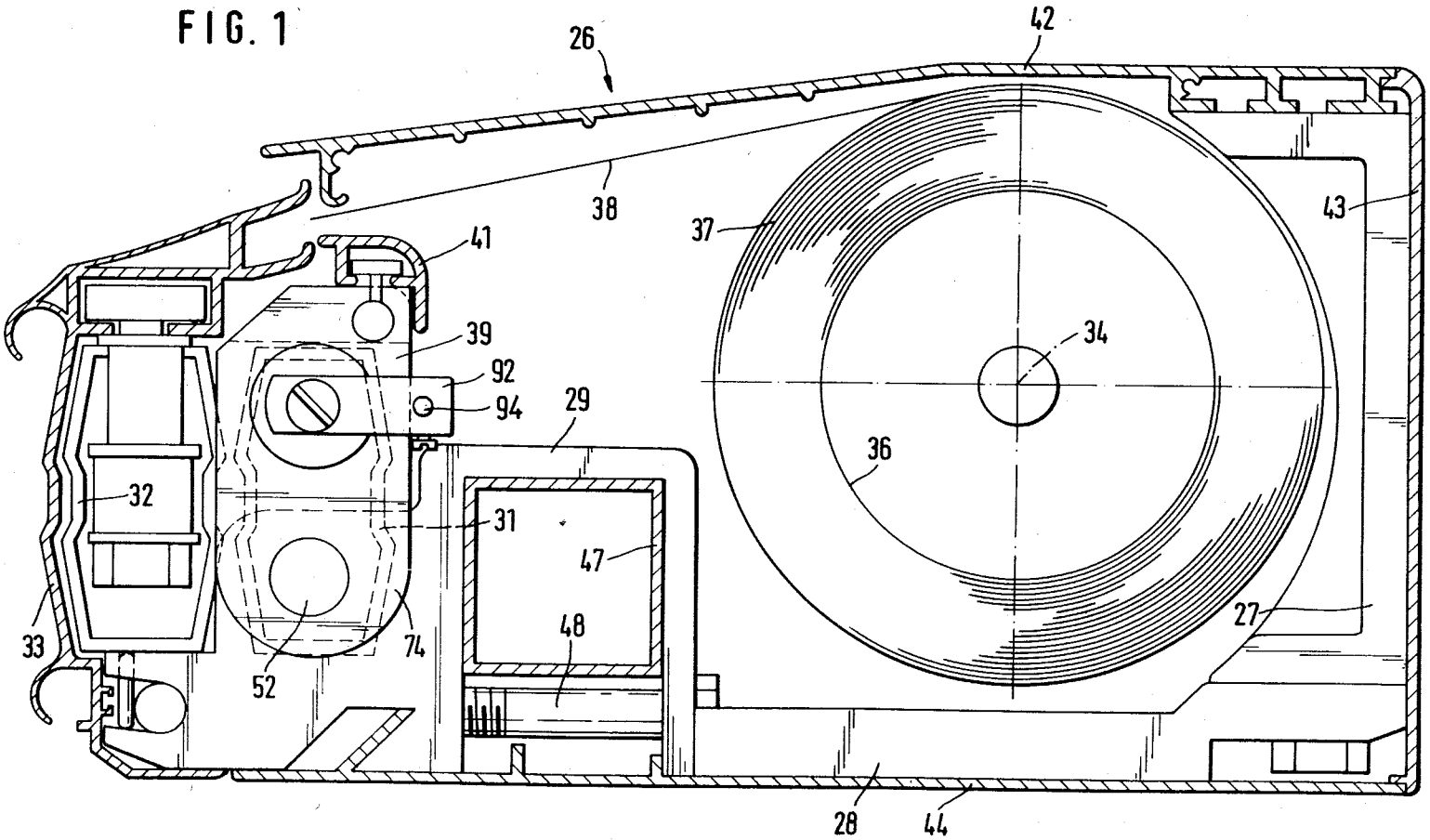
FIG. 1 shows a cross-section approximately along the line I—I of FIG. 2 through a first exemplary embodiment, however, in the fully retracted position of the awning.

According to FIG. 1 a tilting joint arm machanism 26 comprises a support frame consisting of a C-profile 27, onto which a forward projecting support arm 28 is screwed from beneath. A support block 29 is connected rigidly to the support arm 28 in front. Apart from components which remain to be described, dash lines indicate an internal joint arm section 31, an external joint arm section 32, folded together through their intermediate joint (shown in FIG. 3), as usual, and terminal bar or sally profile 33. An awning shaft 36 on which a coil of awning cloth 37 is wound up is rotatable on the inside at the back about a geometric transverse axis 34. The outer part section 38 of said awning cloth being held on the sally profile 33 at the back on top. An awning deflector profile 41, which also deflects the awning in the 90° lowered position of the same, a position shown in FIG. 18 for the third exemplary embodiment, is provided on the back of a tilting joint assembly 39 at the top. In this first exemplary embodiment there is an awning box mounted on the support frame and having a roof 42, a rear wall 43 and a bottom 44. The support block 29 rides with an U-profile 46 upon a square support tube 47, forming part of the support frame. A clamping screw 48 clamps the U-profile 46 firmly to the support tube 47. The support block 29, which is shown in detail in FIG. 11, has a joint lug 49 with a transverse bore 51, the width of which (when seen from the front side), corresponds to the dimension "x" in FIG. 5. Into the transverse bore 51 a joint pin 52 (FIG. 1) will be inserted which projects (as best seen in FIG. 2) beyond the joint lug 49 of the support block 29 to both sides, so as to fit into transverse bores 76 in the tilting joint assembly 39.

According to FIG. 11, the support block 29 has on its front side a bearing jaw 53 that opens to the front. This jaw 53 can be closed to the outside by a pin 54 to be driven from above into suitable holes, not referenced. The joint lug 49 has in its lower front range (FIGS. 9 and 11) a wide incision 56, so that two fork tines 57,58 are produced, each of which having a bearing jaw 53. A nut 59 fitting into the incision with some clearance is, thus, practically immovable to right and left according to FIG. 9, as it is gripped between the two fork tines 57,58. However, since circular cylindrical journals 61, 62 protrude from both sides of the nut 59, a pivoting movement of the nut 59 about the geometrical horizontal axis 63 is possible.

According to FIG. 9, the joint lug 49 is provided with a central recess 64 with a bottom 66 rising obliquely upwards according to FIG. 11. The bottom 66 also passes through the joint pin 52 (FIGS. 1,2,4) which has a corresponding cut-out in its central range. By this cut-out the joint pin 52 is weakened, of course, but a weakening by one half, as is necessary according to FIG. 11, is acceptable. The central recess 64 is wider than a screw bolt 67 which serves as a tilting limiter for the tilting movement of a bearing block body 69 pivoted by the pin 52. The bolt 67 is screwed by its external screw thread into the internal screw thread of the nut 59 at right angles to the geometrical horizontal axis 63, that is to say also at right angles to the parallel extending support tube 47 (FIG. 1) and to the geometrical transverse axis 34 of the shaft 36. The bolt 67 carries at its lower end a transverse key 68, so that the screw bolt 67 can be rotated from obliquely below when it is accessible, i.e. when the mechanism of FIG. 1 has opened somewhat (the profile 33 together with the joint arm section 32 has moved to the left of FIG. 1) by unwinding the cloth roll 37 by a suitable actuation device (not shown). Under the weight of the profile 33 and the joint arm sections 31, 32, the body 69 will then tilt about the joint pin 52 until it abuts on the top of the screw bolt 67, i.e. from the vertical position shown in FIG. 1 into a position determined by the position of the bolt 67. When the screw bolt 67 is screwed fully in, this corresponds to the vertical position. When it is screwed fully out, this corresponds to the horizontal position. In this way, the angle of the extended awning can be determined. As best seen from FIGS. 1, 9 and 10, the screw bolt 67 has in its upper range a neck 71 of reduced diameter merging into a ball 72 which in turn merges on its top into a distance pawl 73 having a dome surface 108 on its top.

Figure 2:
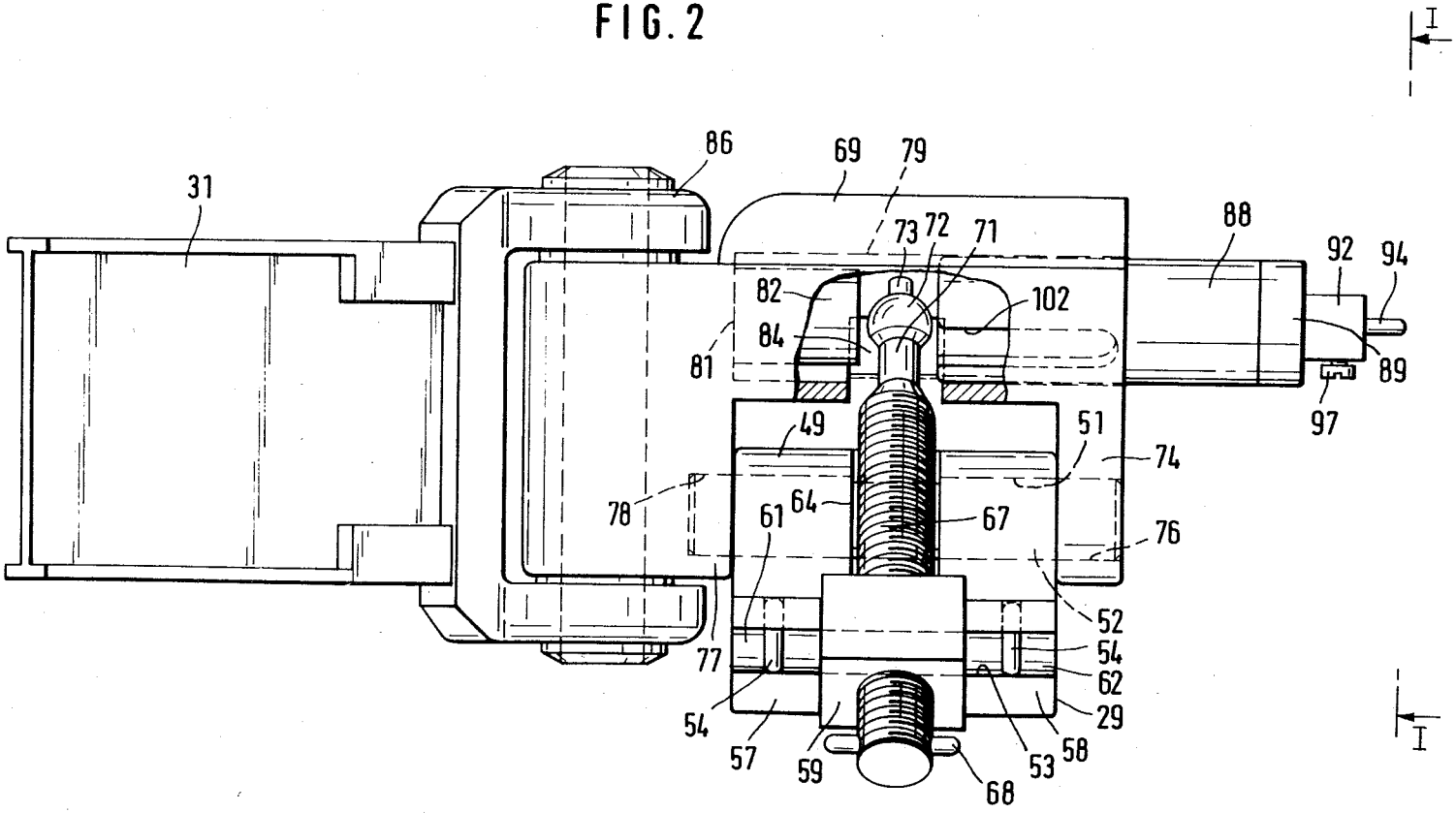
FIG. 2 illustrates the region around the tilting joint of the bearing block body alone, but contrary to FIG. 1, after the mechanism has tilted forward, viewed from the front side (left in FIG. 1)
Figures 3, 4:
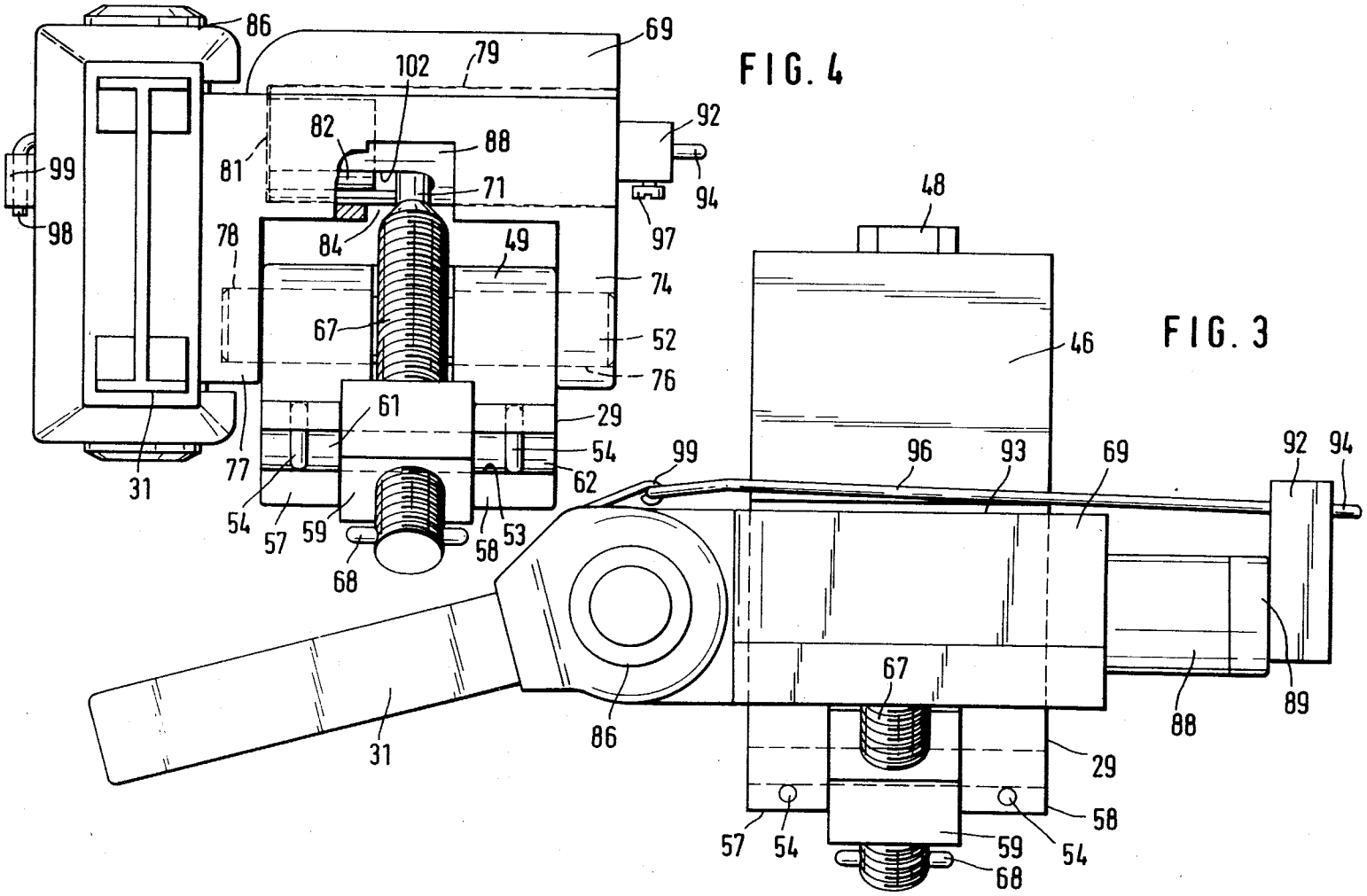
FIG. 3 is a top view of FIG. 2.
FIG. 4 shows a view similar to FIG. 2, but in the totally extended position of the awning.
Figure 12:
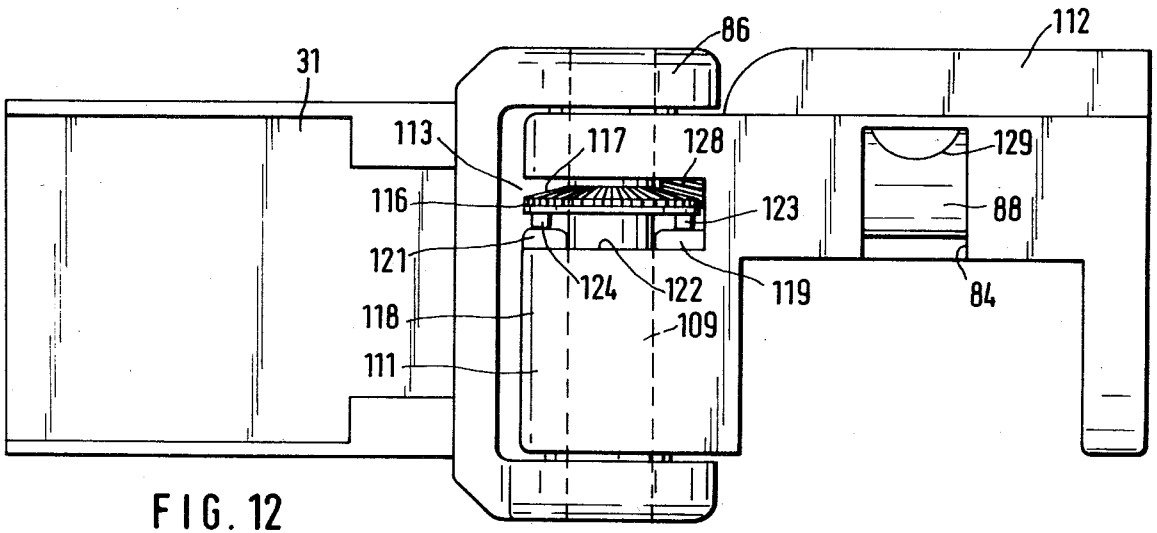
FIG. 12 shows a second exemplary embodiment of a bearing block body with the internal joint, viewed from in front (as in FIG. 2), in which the support block and the screw bolt are omitted.
Figure 13:
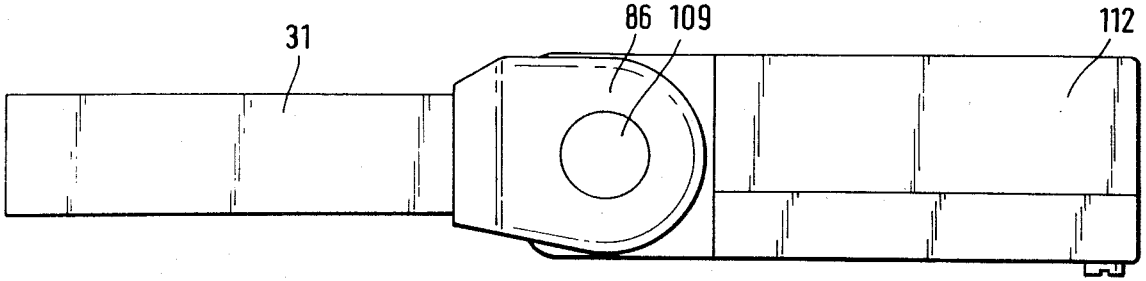
FIG. 13 is a top view of FIG. 12.

The body 69 is largely bifurcate (FIGS. 2, 4, 5). Its right-hand fork cheek 74 has a transverse bore 76 to receive the joint pin 52. In alignment with the transverse bore 76, a blind hole 78 for receiving the other end of the joint pin 52 is provided in the left-hand fork cheek 77. Above the fork cheeks 74,77 a blind hole 79 of larger diameter is provided in the body 69, the bottom 81 of which extends approximately to the left-hand reference mark for the dimension "x" in FIG. 5. From this bottom 81, a bearing cylinder 82 extends to the right coaxially to the geometrical median axis 83 of the blind hole 79. The external diameter of the bearing cylinder 82 is however smaller than the diameter of the blind hole 79 by a wall thickness "y" which will be discussed later in connection with FIG. 8. As is clear from FIG. 5 in conjunction with FIG. 6, the body 69 is provided with an incision 84 extending symmetrically with respect to the longitudinal axis 70 of the screw bolt 67 shown in FIG. 9 which-in conjunction with FIG. 5 - represents an exploded view of the body 69 and the bolt 67. As is clearly shown in FIG. 5, the bearing cylinder 82 projects somewhat over the incision in order to provide an abuttment surface for the ball 72 when the latter has entered the incision, so that the ball 72 and the axis 70 are centered with respect to the incision 84. The incision 84, namely, is wider than the diameter of the ball 72 and intersects the blind hole 79 approximately as far as to the median axis 83. As FIG. 5 shows, the left-hand fork cheek 77 is sufficiently wide to be able to form the lug portion for the internal joint 86 of the internal joint arm section 31.

A tube 88 (FIGS. 2–4 and 7)is approximately as long as the blind hole 79 and can move virtually without play in the latter along the median axis 83. The tube 88 is mounted for rotation about the median axis 83, namely through a bearing piece 89 not rotatable there with. This bearing piece 89 is rigidly connected to a tab 92 by means of a screw 92. As best seen from FIG. 3, the tab 92 passes to the rear, i.e. behind the rear surface 93 of the body 69. The rear region of the tab 92 is penetrated by one end 94 of a push rod 96, which is loadable in traction and compression. The end 94 is adjustably clamped by a clamp screw 97. The push rod 96 extends close to the rear surface 93 and has an angled portion 98 on the left of FIG. 7. This angled portion 98 is hooked into an eye 99 (FIG. 3) which is rigidly connected to the joint arm section 31 behind the joint 86. The opening and folding movement of the joint arm section 31 is thus converted into a movement of the push rod 96 directed to left and right, and this correspondingly entrains the tube 88. When the tube 88 occupies its inner position in the blind hole 79 (FIG. 4), the left-hand end portion of the tube 88 slides on the circumference of the bearing cylinder 82, so that this end portion is positively guided between the blind hole 79 and the bearing cylinder 82.

The tube 88 has an inner end face 101 (FIG. 7). From this end face 101 a first U-incision 102 extends parallel to the longitudinal axis of the tube 88, said incision 102 being slightly wider than thickness of the neck 71 of the screw bolt 67 in order to embrace the same in the position of FIG. 4. When the tube 88 is fully inserted into the blind hole 79 (as in FIG. 4), the U-bottom 103 (FIG. 7) surrounds the right-hand half circumference of the neck 71.

Diametrically opposite to and in alignment with the U-incision 102, the rear range of the tube 88 is provided with an U-incision 104, the width of which is slightly greater than the diameter of the distance pawl 73 of the screw bolt 67, and the U-bottom 106 of which is located somewhat farther to the left in FIG. 7. The diameter of the ball 72 is adapted to engage and slide along the internal surface 107 (FIG. 8) of the tube 88. Spring means, not shown, may be provided to bias the screw bolt 67 against the bottom 66 in FIG. 11, although this is normally unnecessary.

The mechanism operates as follows: In the retracted position of the awning according to FIG. 1, the tube 88 is located fully to the right with respect to FIG. 2 which shows the situation after the awning has been unwound from its coil 37, so that the bearing block body 69 has tilted downwards against the top of the screw bolt 67. In the retracted position of the awning (FIG. 1), the screw bolt 67 rests upon the bottom 66 (FIG. 11) and is aimed into the incision 84. When the awning is unwound from the coil 37, the body 69 together with the joint arm sections 31,32 and the awning itself tilts downwards.

During and before this movement the tube 88 is displaced to the left (with respect to FIG. 2), and at the moment of tilting of the body 69 the distance pawl 73 strikes with its dome surface 108 the opposite inner surface of the blind hole 79, thus limiting the tilting angle of the bearing block assembly 39 and the angle of inclination of the awning. Due to the chosen transmission ratio between the movement of the joint arm section 31 and the tube 88, the latter moves very rapidly to the left and catches the ball 72 which enters the tube 88. Due to the distance pawl 73 the ball 72 does not rub against the internal surface 107 (vide FIGS. 7, 8) of the tube 88, but is centred with respect to this tube. In the position of FIGS. 2 and 3 the tube 88 is just about to catch the ball 72, whereas in the position of FIG. 4 the neck 71 is already totally surrounded by the U-incision 102. Then the awning is virtually totally extended. The farther the tube 88 moves inwards, the more it slips on the bearing cylinder 82 on the left. When the screw bolt 67 is unscrewed by the transverse key 68, the awning is lowered. The tube 88 can always maintain the same position relative to the neck 71, since of course a rotary connection is present between the bearing piece 89 and the tube 88. Thus, whereas the top of the bolt 67 acts as a tilting limiter, the fact that its ball is caught by the tube 88 prevents also any movement in the counter-direction, i.e. a tilt-up movement due to gusts. In this way, a tilt-up check is realized.

In the second embodiment according to FIGS. 12 to 17, the support block 29 including joint lug 49 et cetera are omitted from the drawing and the description. The screw bolt 67, likewise not described and not illustrated, with neck 71 and ball 72 (as in the foregoing figures) is used also in this case. However, the distance pawl 73 will be omitted in this embodiment, since it is not necessary. Again, there is the joint 86 of the internal joint arm section 31. A joint pin 109 is fastened to the joint arm section 31 to rotate with it as a shaft and connects the joint arm section 31 to an associated joint lug portion 111 bearing block body 112. The whole can best be seen by comparing FIG. 5 of the first embodiment with FIG. 16 of this embodiment.

Figure 16:
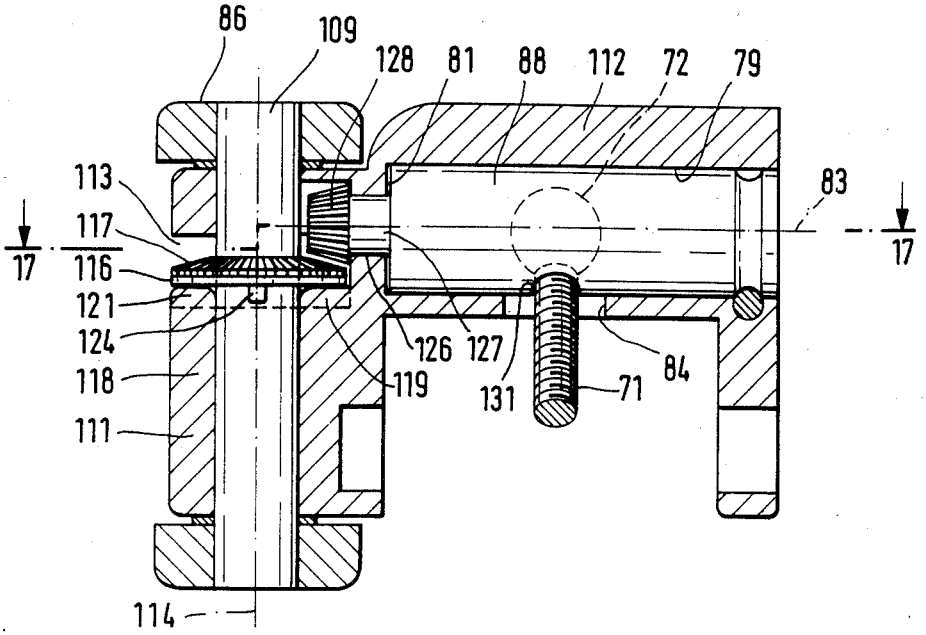
FIG. 16 shows a section with extended awning similar to FIG. 15, illustrating the position of the screw bolt.

The joint lug portion 111 has a wide incision 113 which extends transversely to the joint pin 109 and virtually to the actual body 112. A bevel wheel 116 is located in this incision 113 coaxially to the geometrical longitudinal axis 114 (FIG. 16). It has upward directed teeth 117. The bevel wheel 116 is connected for common rotation to the pin or shaft 109 and thus to the joint arm 31 in a manner not shown. It can however move up and down within the incision 113 by at least the height of the teeth 117, preferably more. The lower block 118 of the joint lug portion 111 has, directly beneath the bevel wheel 116—as viewed in FIGS. 14, 16 and 17—, a respective cam elevation 119, 121 each at 3 o'clock and at 9 o'clock, i.e. shifted to each other by 180°, which has a total length of approximately 10° symmetrically to the longitudinal axis 83, whilst the elevations 119,121 each exhibit ramps at both ends through which they pass over to a lower annular surface 122. The bevel wheel 116 has on its underside mutually diametrally opposite downward directed cam followers 123,124 angularly substantially less than 10° long, which can slide up over the ramps onto the elevations 119,121. The bevel wheel 116 is thus pushed upwards in the position shown in FIGS. 12 and 13 to come into engagement with a bevel gear 128. Even in the position shown in FIG. 14, that is to say after a slight outward movement of the joint arm 31, the bevel wheel 116 slides downwards again, namely due to its weight and/or to a compression spring not shown. In this way, the gears 117 and 128 will become disengaged. Thus, it is evident that the cams 119,121 function as a shifting clutch.

Figure 14:
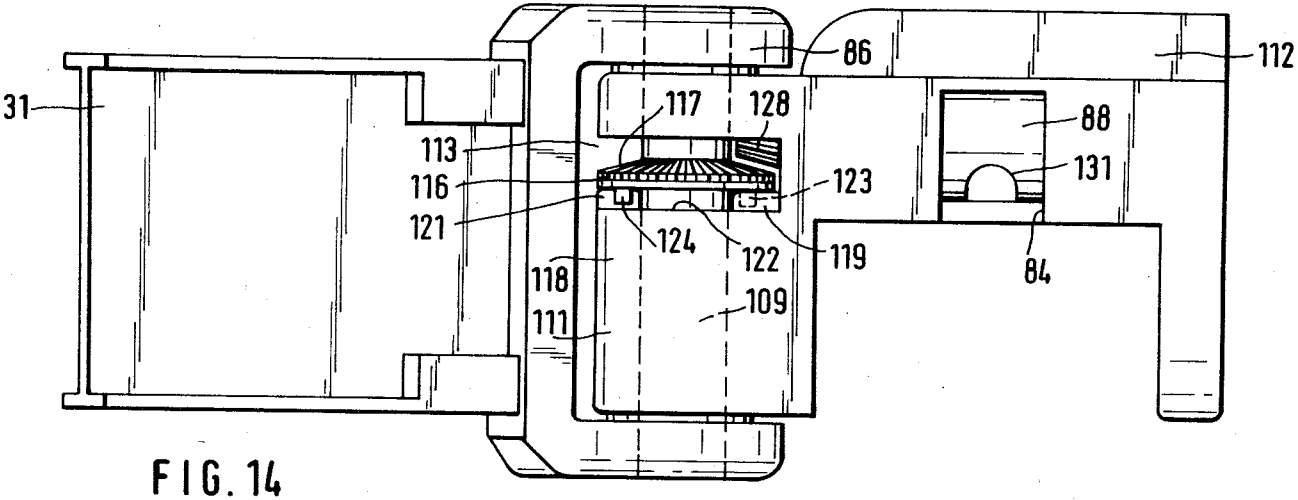
FIG. 14 shows a view similar to FIG. 12, but when the awning is somewhat extended.
Figure 17:
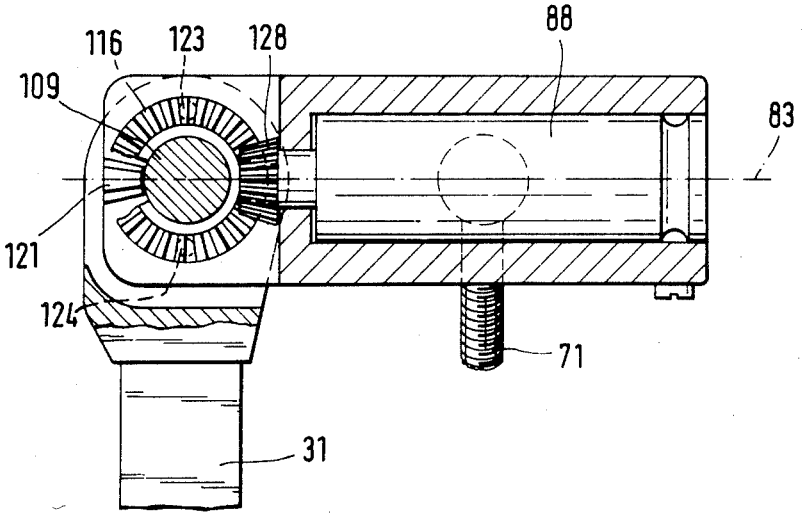
FIG. 17 shows a section along the line 17—17 of FIG. 16.

The blind hole 79, also provided in this case, as may be seen from FIG. 16, contains a tube 188 which corresponds in function to the tube 88 of the foregoing embodiment, but can rotate in the blind hole 79 about its longitudinal axis 83 and is not slidable in axial direction. The bottom 81 of the blind hole 79, in this embodiment, has a coaxial bearing bore 126, which is penetrated by a shaft 127 fixed to the tube 188. The bevel gear 128 is mounted on the left side of the shaft 127. This bevel gear 128 meshes, as already mentioned above, with the bevel wheel 116 when the latter is pushed upwards by the elevations 119,121. The transmission ratios and the length of the elevations 119,121 is chosen so that even for approximately 10° outward movement of the joint arm 31 the bevel gear 128 has done its work and is disengaged from bevel wheel 116. The work consists in rotating the tube 188. This tube 188 has a keyhole slot developed in the peripheral direction with in the range of the incision 84. This keyhole slot consists of a circular hole 129 which can just be seen appearing at the top in FIG. 12 and which is sufficiently large for receiving the ball 72 of the screw bolt 67 (FIGS. 9, 10). Starting from the hole 129, backwards in the peripheral direction in FIG. 12, there follows a narrower slot 131 (FIG. 14) which is narrower than the diameter of the ball 72, but wide enough to receive the neck 71 (as is indicated in FIGS. 16 and 17). In FIG. 14 the slot 131 is just traveling past the incision 84 and is disappearing at the lower edge of the latter.

Figure 15:
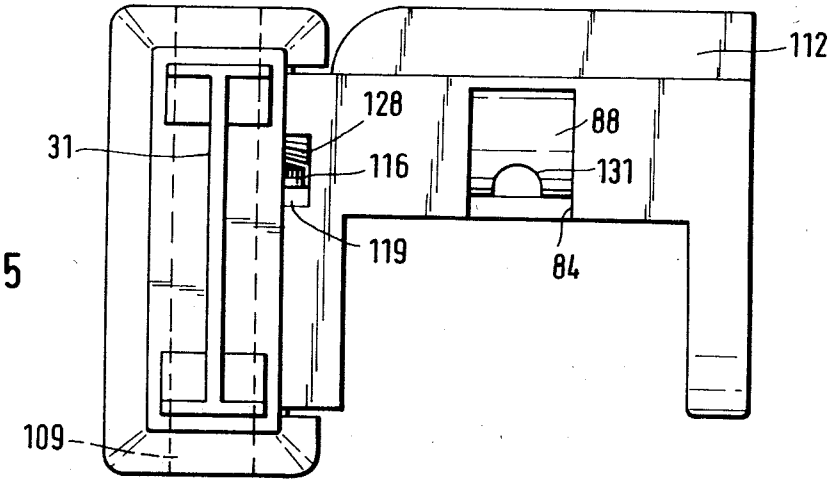
FIG. 15 is a further view similar to FIG. 12, but when the awning is totally extended.

Although in the position of FIG. 15 the joint arm section 31 has been rotated substantially farther than in FIG. 14, the tube 188 does no longer rotate due to the shifting clutch effect of the cams 119,121, and the slot 131 has scarcely moved. The bottom of the slot 131, pointing upwards in FIG. 15, therefore encloses the neck 71 of the screw bolt (FIGS. 16, 17). When the bearing block body 112 tilts forward (as described with reference to the assembly 39 in the foregoing embodiment), therefore, the ball 72 passes through the hole 129 into the tube 188 and remains captive in the tube 188 after even a small pivotal movement of the joint arm section 31 and a corresponding rotation of the tube 188. This position is also maintained during the further outward pivoting of the joint arm section 31, whereby any tilting in upward direction is prevented.

Figure 18:
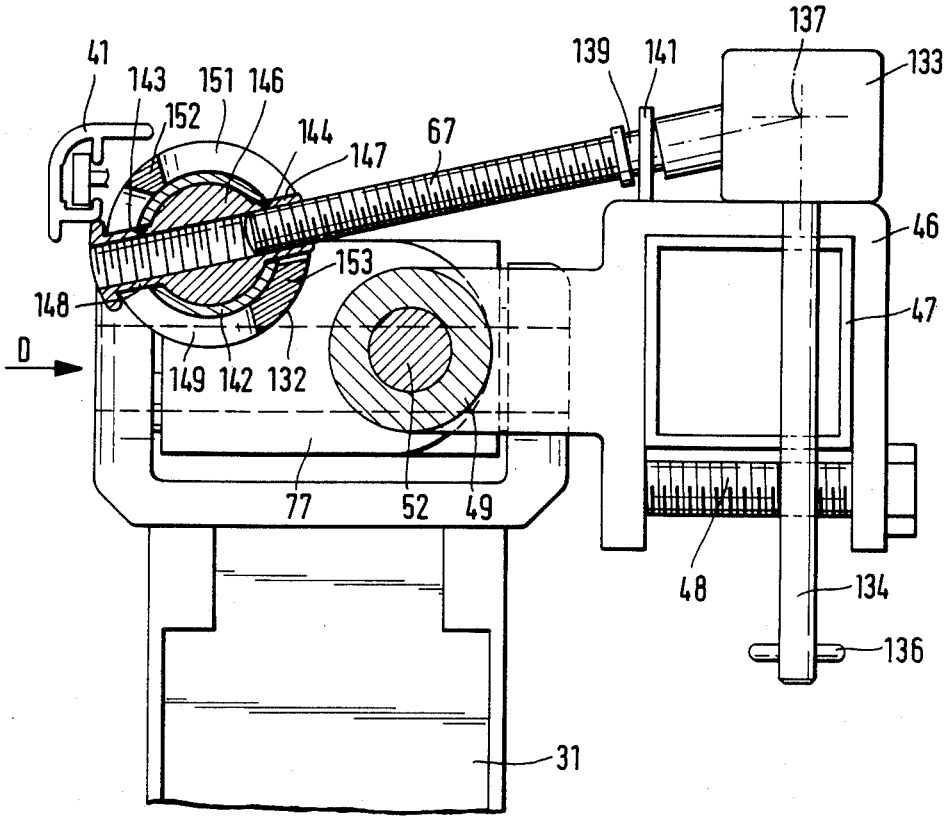
FIG. 18 shows a side-view similar to FIG. 1 for a third exemplary embodiment, but only in the region of the bearing block body, and when the awning is lowered by 90°.
Figure 21:
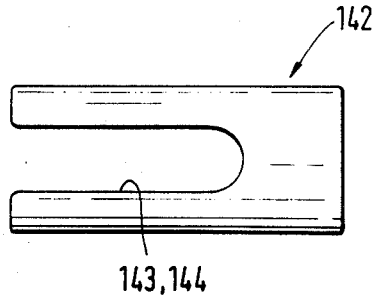
FIG. 21 shows a view of the holding tube used in the third exemplary embodiment.
Figure 19:
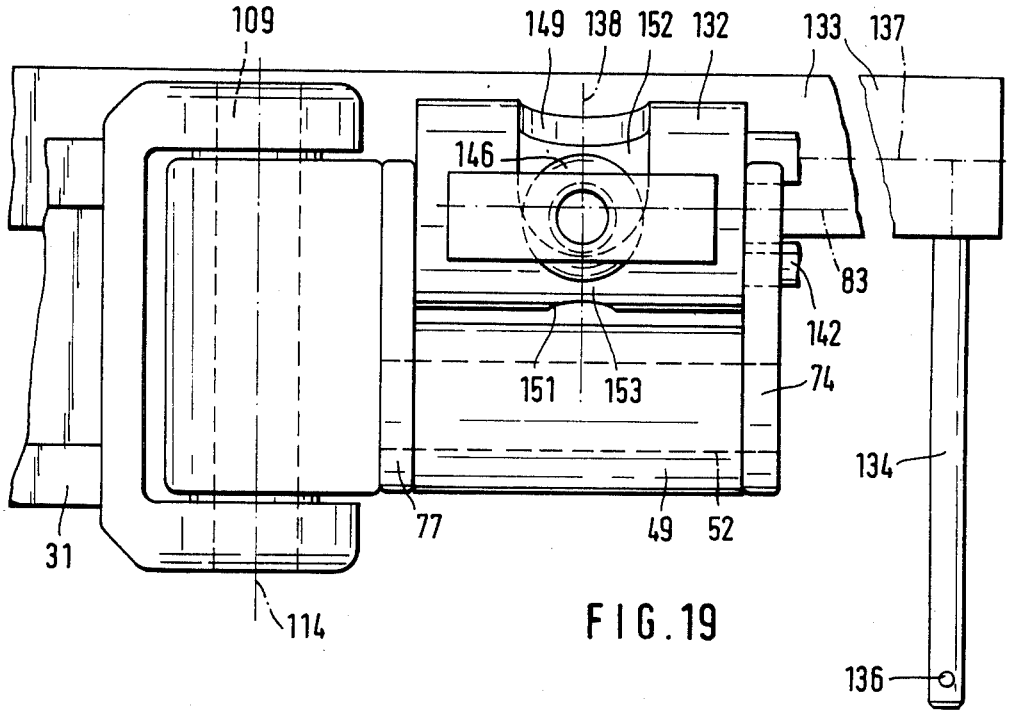
FIG. 19 shows a view according to the arrow D in FIG. 18, but when the awning is in retracted position.
Figure 20:
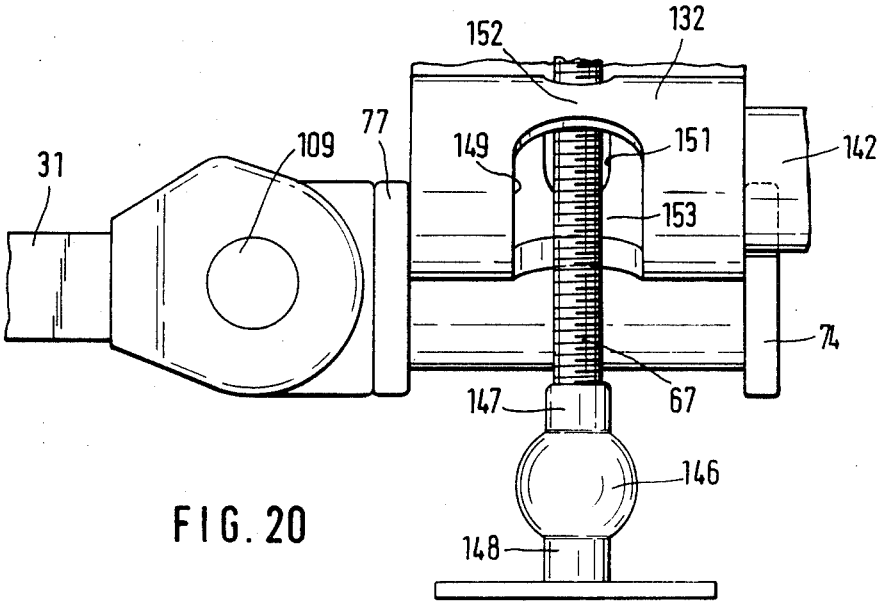
FIG. 20 is a top view onto the bearing block body and to FIG. 19 illustrating the position of the screw bolt, when the awning is retracted.

In the third embodiment according to FIGS. 18 to 20, the support tube 47, the clamping screw 48, the joint lug 49, the internal joint arm section 31, the geometrical longitudinal axis 114 of the joint pin 109, the fork cheeks 74,77, the joint pin 52, a body 132 (having the function of the bodies 69 or 112 of the foregoing embodiments) of a bearing block assembly 135, a screw bolt 167 and also the awning deflector profile 41 will be recognized. The difference, as compared to the previous embodiments is that a transmission gear is provided within a square profile 133 (FIG. 18), by which the bearing block assemblies of a plurality of joint arms distributed over the total width of the awning can be adjusted at once. The square profile 133 is mounted upon the U-profile 46 and projects to the right with respect to FIG. 19 along the support tube 47. For actuating the gear an operating shaft 134, which has a transverse key 136 similar to the transverse key 68 of the first embodiment (e.g. vide FIG. 9), projects downwards to the right of the support tube 47. The operating shaft 134 disappears in the profile 133 placed at the top and serving as a protection and assembly reference element. Above the operating shaft 134 a bevel gear transmission is provided in a manner only indicated in dotted lines in the profile 133; it permits a transmission to all screw bolts 167 that may be arranged together with a respective bearing block assembly along the width of the awning by a shaft to be driven about a geometrical transverse axis 137. This transverse axis 137 extends to the left of FIG. 19. The screw bolt 167 emerges from the profile 133 in a median plane 138, and has on its top a bevel gear meshing with similar bevel gear of the shaft in the profile 133. An annular collar 139 is provided on the screw bolt 67 above the U-profile 46; it pentrates a bearing plate 141 attached rigidly to the transverse yoke arc of the U-profile 46. The bearing plate 141 absorbs the tensile and shear forces occurring in the screw bolt 67, and nevertheless permit the screw bolt 67 to be pivoted about the axis 137 from the position shown in FIG. 18 into one substantially higher. The body 132, which is provided rigidly between the fork cheeks 74,77 (vide FIG. 19) has in this embodiment the configuration of a tube, in which a tube 142 (vide FIG. 21) being similar to the tube 88 of FIG. 7 is provided. Here, however, the front U-incision 143 is precisely as large as the rear U-incision 144, since both incisions 143,144 serve to form a passage for collars 147,148 of a ball nut 146 (FIGS. 18 and 20). The operating device for displacing the tube 142 within the body 132 correspondingly to the position of the joint arm section 31, has been omitted for simplicity, since precisely the same design may be applied here as in the first embodiment. The ball nut 146, which fits into the tube 142, is screwed on to the screw bolt 167. The ball nut 146 is provided with the integral collar 147 pointing to the rear and likewise the forward projecting collar 148, both of which project out of the body 132 (FIG. 18).

In order that the collars 147, 148 can rotate angularly about the geometrical longitudinal axis 83 unobstructedly, the body 132 is provided with an elongate slot 149 in front and an elongate slot 151 behind (FIGS. 18, 19). Two narrow webs 152 and 153 in each case then remain between them. Even in the case of very long slots 149,151 the webs 152,153 have adequate rigidity to absorb any forces acting.

As may be seen in FIG. 20, the collar 148 has a transverse plate on its lower end which may abut the external surface of the body 132, as shown in FIGS. 18 and 19. This is the case when the awning is tilted forward. The plate, having entered between the fork cheeks 74 and 77, prevents the ball nut 146 from being entrained due to friction when the screw bolt 167 is rotated. If the ball nut 146 were to participate in rotation, then of course no adjustment of the inclination angle of the awning would be possible, since the position of the ball nut along the bolt 167 determines the tilting angle of the bearing black assembly 135, as will be easily understood from FIG. 18. However, since the ball nut 146 will be caught by the tube 142, it prevents also an unintentional tilting-up of the assembly 135 as a result of upward directed winds blowing in the awning from below.

What I claim is:

1. In a joint arm mechanism for an awning
support means defining
a horizontal tilting axis, and
a horizontal swivel axis;
shaft means for receiving a coil of the awning, said shaft means extending parallel to said tilting axis and being supported by said support means;
bearing block means tiltable from an initial position, in which said awning is fully coiled onto said shaft means, about said horizontal tilting axis, said bearing block means including
joint means defining a pivot axis extending substantially normally to said tilting axis, and
abutment means for limiting the tilting movement which comprises a recessed body;
joint arm means pivoted by said joint means and comprising
a first joint arm section having two ends and being connected to said joint means with one of these ends,
an intermediate joint at the free other end of said first arm section, and
a second joint arm section connected to said intermediate joint;
tilting limiter means for limiting the tilting movement of the bearing block means about said tilting axis, said tilting movement from said initial position of said bearing block means occurring when said awning is uncoiled, said tilting limiter means including
screw means defining a longitudinal axis and being rotatably about said longitudinal axis and swingably supported on said swivel axis, but substantially undisplaceable in axial direction,
actuating means to rotate said screw means through one of their ends which is averted from said bearing block means, and
counter-abutment means on said screw means for engaging said abutment means, said counter-abutment means including a body of rotation generated about said longitudinal axis and being located within the range of the other end of said screw means that faces said bearing block means, said body of rotation having a periphery which fits into the recessed body of said abutment means;
in the initial position, said abutment means and counter-abutment means being out of engagement and said counter-abutment means being directed towards said abutment means.

2. A joint arm mechanism as claimed in claim 1, wherein said support means comprise rest means for directing said counter-abutment means towards said abutment means.

3. A joint arm mechanism as claimed in claim 1, wherein said body of rotation is ball-shaped.

4. A joint arm mechanism as claimed in claim 1, further comprising nut means for receiving said screw means, said nut means being supported by said horizontal swivel axis in front of and below said tilting axis.

5. A joint arm mechanism as claimed in claim 1, wherein said recessed body comprises through hole means for receiving said screw means which pass through with their end averted from said actuating means, said counter-abutment means comprising internal thread means to be screwed onto this end averted from said actuating means.

6. A joint arm mechanism as claimed in claim 5, wherein said support means comprise retaining means for said screw means to absorb tensions acting upon said screw means, said retaining means being arranged in a plane above said tilting axis and in the range of said swivel axis.

7. A joint arm mechanism as claimed in claim 1, wherein said bearing block means include guide means, the mechanism further comprising
catch means movably guided by said guide means for catching said counter abutment means in order to prevent a tilt-up movement of the bearing block means, said catch means being movable from an unblocking position to a catching position and comprising: tube means having a median axis and an outer wall, narrow slot means in said outer wall having a width smaller than that of said body of rotation to catch the same; and
operating means connected to said joint arm means to move said catch means simultaneously with said joint arm means.

8. A joint arm mechanism as claimed in claim 7, wherein said tube means are slidably guided along said guide means, said narrow slot means being open ended on one end of said tube means and extending parallel to said median axis.

9. A joint arm mechanism as claimed in claim 8, wherein said body of rotation is arranged just on one end of said screw means and comprises spacer means protruding in opposite direction of said screw means, moreover being provided with a counter-abutment surface on their end and having a length corresponding to the thickness of the outer wall of said tube means, said tube means having further slot means located diametrically opposite to said narrow slot means and being also open ended to receive said spacer means when the same engages said abutment means by said counter-abutment surface.

10. A joint arm mechanism as claimed in claim 7, wherein said tube means are rotatably guided by said guide means, said operating means comprising rotation imparting means, and said norrow slot means extending in peripheral direction and ending in a widened opening to receive said counter-abutment means at the end of said tilting movement.

11. A joint arm mechanism as claimed in claim 10, wherein said tube means have a first end directed toward said joint means, said joint means including pivot shaft means connected to said first joint arm section for common rotation, said rotation imparting means comprising first bevel gear means connected to said first end of the tube means for common rotation, and second bevel gear means connected to said pivot shaft means for common rotation.

12. A joint arm mechanism as claimed in claim 10, wherein said rotation imparting means comprise clutch means controlled by the movement od said first joint arm section to interrupt the transmission of movement of the latter to said tube means.

13. A joint arm mechanism as claimed in claim 11, wherein said rotation imparting means comprise clutch means controlled by the movement of said first joint arm section to interrupt the transmission of movement of the latter to said tube means, and wherein said second bevel gear means are displaceable along said pivot shaft means and comprise cam follower means, said clutch means comprising cam means arranged on said bearing block means and being in engagement with said cam follower means to displace said second bevel gear means into and out of engagement with said first bevel gear means.

14. A joint arm mechanism as claimed in claim 13, wherein said cam means and said cam follower means are arranged at the bottom side of said second bevel gear means which side is free of teeth.

* * * * *